US006709226B2

(12) United States Patent
Maejima et al.

(10) Patent No.: US 6,709,226 B2
(45) Date of Patent: Mar. 23, 2004

(54) VACUUM PUMP

(75) Inventors: Yasushi Maejima, Narashino (JP); Yoshiyuki Sakaguchi, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 58 days.

(21) Appl. No.: 10/187,573

(22) Filed: Jul. 2, 2002

(65) Prior Publication Data

US 2003/0021673 A1 Jan. 30, 2003

(30) Foreign Application Priority Data

Jul. 5, 2001 (JP) ..... 2001-204496

(51) Int. Cl.[7] ..... F04D 19/04

(52) U.S. Cl. ..... 415/9; 415/90; 415/118; 416/144

(58) Field of Search ..... 415/9, 90, 118, 415/196, 217.1; 417/423.4; 416/144

(56) References Cited

U.S. PATENT DOCUMENTS 3,490,748 A * 1/1970 Hofffman ..... 415/9
2002/0159899 A1 * 10/2002 Yamashita ..... 415/90
2003/0021672 A1 * 1/2003 Maejima et al. ..... 415/90

* cited by examiner

*Primary Examiner*—Edward K. Look
*Assistant Examiner*—Richard A. Edgar
(74) *Attorney, Agent, or Firm*—Adams & Wilks

(57) ABSTRACT

To provide a vacuum pump used for semiconductor manufacturing, which has improved reliability and safety and in which damages to a pump casing, peripheral apparatuses, or the like are prevented from occurring by preventing the occurrence of rotor breakage due to corrosion. A balancer is provided in the outer circumferential surface of the rotor so as to face the inside of the gas passageway. A balancer main body is supported against the outer circumferential surface of a rotor through a fragile portion that is weak with respect to corrosive gasses, the fragile portion of the balancer is damaged by corrosion before any corrosive gas influence appears in rotor blades or the rotor, and the balancer falls off, thus forcibly causing an unbalanced state to appear in the rotor. The balancer thus possesses a function for balancing the rotor and a corrosion detecting function. The unbalanced state of the rotor is then detected by a sensor, and damages to the vacuum pump itself and to the peripheral apparatuses can be prevented by stopping the pump.

8 Claims, 4 Drawing Sheets

① · BALANCER FALLS OFF

↓

② · UNBALANCED STATE DEVELOPS

↓

③ · DETECT ERROR (BIG DISTURBANCE DETECTING FUNCTION)

↓

④ · PUMP STOPS

FIG. 4
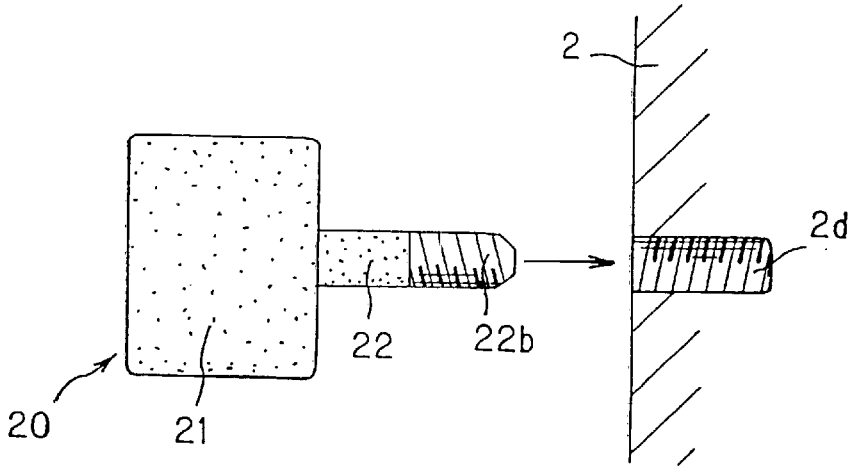
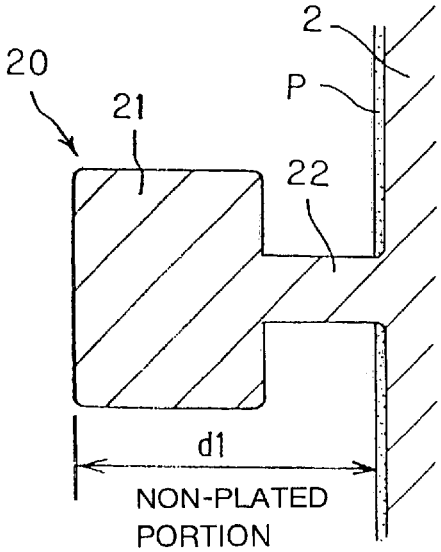
FIG. 5A
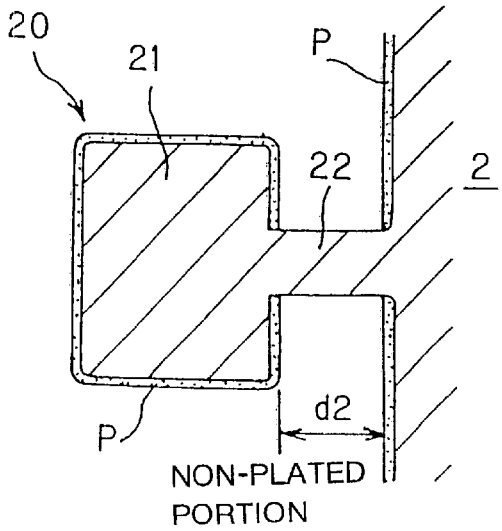
FIG. 5B

VACUUM PUMP

BACKGROUND OF THE INVENTION

1. Field of the Invention

The present invention relates to a vacuum pump, typically a turbo molecular pump used in a semiconductor manufacturing apparatus. In particular, the present invention relates to a vacuum pump in which damage to a rotor occurring due to a corrosive gas is prevented, thereby increasing the reliability and safety of the pump and peripheral apparatuses.

2. Description of the Related Art

As means for exhausting corrosive gasses from vacuum chambers, vacuum pumps such as turbo molecular pumps are used during semiconductor manufacturing processes such as dry etching and CVD.

FIG. 6 shows the basic structure of a conventional vacuum pump. A rotor 2 having a plurality of blade-like rotor blades 1 that are processed integrally along an upper outer circumference thereof, and a rotor shaft 3 attached integrally on a rotation center axis of the rotor 2 are accommodated inside a pump casing 4.

The rotor shaft 3 is rotatably supported through a bearing 6 in a stator column 5 that protrudes from a stator base 13 supporting the pump casing 4. Further, a driving motor 7 is inserted between the stator column 5 and the rotator shaft 3, and the rotor shaft 3 and the rotor 2 are rotated at high speed by the driving motor 7.

In addition, a plurality of blade-like stator blades 10 disposed alternately between the rotor blades 1 are imposed in an internal circumferential surface of the pump casing 4 through spacer rings 10*a*. Gas is sucked up from an inlet port 8 above the rotor 2 due to interaction between the rotor blades 1 rotating at high speed and the stator blades 10. The gas is exhausted to an exhaust port 9 below the rotor 2, so that the inside of a semiconductor processing vacuum chamber 14 connected to the inlet port 8 is placed in a high vacuum state.

Further, a rotating cylindrical surface 2*b* in an outer circumference of a skirt portion 2*a* in a lower half portion of the rotor 2 is fixed within the pump casing 4, and a screw stator 11, which is in sliding contact with the rotating cylindrical surface 2*b* so as to surround it, is fixed within the pump casing 4. Within a helical shape thread groove 12 formed in the inner circumferential surface of the screw stator 11, gas molecules, which are sent downward while passing between the rotor blades 1 and the stator blades 10, are carried to the gas exhaust port 9 side by the rotating cylindrical surface 2*b* of the rotor skirt portion along the thread groove 12, and exhaustion of the gas being in a slightly reduced vacuum state is performed.

For cases in which a vacuum pump having this type of structure is used in semiconductor manufacturing processes, the pump is often exposed to halogenated gases (hereafter referred to as corrosive gases) that are generated during processing such as dry etching and CVD. An aluminum alloy is normally used as a material for the rotor blades 1, the rotor 2, the pump casing 4, the stator blades 10, and the like, and an anti-corrosive (corrosion resistance) plating process is performed on the surface of the aluminum alloy, thus imparting it with anti-corrosiveness property against the corrosive gasses.

However, there are limits to the anti-corrosive plating process; in actuality, corrosion due to the corrosive gasses proceeds in the rotor blades 1 and in the rotor 2 after long usage. In particular, centrifugal force acts on the rotor blades 1 and the rotor 2 due to high speed rotation, and there are cases in which cracks develop from corroded portions, and breakage of the rotor blades 1 and the rotor 2 develops.

If the rotor 2 breaks, then fragments of the rotor 2 are scattered due to the centrifugal force, and rotation of the motor is forcibly stopped. A large stress therefore develops in the stator column 5 as a reaction force, and the stator blades 10 and the pump casing 4 are deformed or damaged, and this may even affect bonding portions with the vacuum chamber 14. The vacuum state of the entire processing apparatus to which the vacuum pump is applied is destroyed, the processing apparatus itself may be damaged, and in addition, there is a concern that this will invite emission of the corrosive gas to the outside, leading to an accident.

In view of the above situation, an object of the present invention is to provide a vacuum pump having increased pump reliability and safety by preventing rotor breakage occurring due to corrosion.

SUMMARY OF THE INVENTION

In order to achieve the aforementioned object, the present invention of this specification is characterized in that it comprises: a hollow cylindrical pump casing which is provided with an intake port communicating with a vacuum chamber and has a plurality of stages of stator blades disposed on an inner circumferential surface thereof; a stator column accommodated and fixed inside the pump casing, for supporting a rotor shaft that rotates at high speed; a rotor integrated with the rotor shaft and having a plurality of stages of rotor blades disposed on an outer circumferential surface thereof such that the rotor blades are disposed alternately with the stator blades of the pump casing; and a balancer provided in the outer circumferential surface of the rotor, for performing rotor balancing during high speed rotation of the rotor; and that the balancer is attached to the outer circumferential surface of the rotor through a fragile portion that is weak with respect to corrosive gasses. When corrosion due to the corrosive gasses within a gas passageway has advanced beyond a fixed degree, the balancer falls off so that an unbalanced state of the rotor forcibly appears.

When the unbalanced state of the rotor develops, in a case where the rotor shaft is supported by a ball bearing, errors may be detected by providing a vibration sensor onto the rotor. Further, for cases in which the rotor shaft is rotationally supported on the stator side by a magnetic bearing, errors may be detected by a rotor shaft radial direction sensor (displacement sensor) mounted between the rotor shaft and the stator.

Driving of the driving motor may be stopped by a signal from the vibration sensor or the displacement sensor.

In accordance with the present invention, the balancer provided in the outer circumferential surface of the rotor is attached to the outer circumferential surface of the rotor so as to face the gas passageway, and in addition, the balancer is supported by the fragile portion which is weak with respect to corrosive gasses. Therefore, due to the fragile portion the balancer falls off when corrosion of the corrosive gas within the gas passageway has advanced beyond a certain degree, so that an unbalanced state can be made to forcibly appear in the rotor.

The rotor therefore falls off from the balancer due to the advancement of corrosion, and an unbalanced state develops in the rotor so that the driving motor stops due to an error detecting means. Thus, the stator blades and the pump casing, and therefore the vacuum system, do not break.

In addition, the balancer that possesses the aforementioned corrosion detecting function also has a balancing function for making the rotor maintain a suitable posture. A portion of the balancer may be simply cut out for performing rotor balancing, so that balance correction is easy to perform. Therefore, compared to conventional balance adjustment work performed by opening holes using a drill or the like, balancing can be completed simply and without lowering the ridigity of the rotor.

The present invention of this specification is characterized in that the fragile portion of the balancer is set in a smaller diameter than that of the balancer main body, and is pressured-fixed through an adhesive within a pinhole formed in the outer circumferential surface of the rotor.

The present invention of this specification is characterized in that the fragile portion of the balancer is set in a smaller diameter than that of the balancer main body, and that the balancer is screwed into the inside of a screw hole drilled in the outer circumferential surface of the rotor.

In accordance with the present invention, the balancer is provided with a corrosion detecting function and a balancing function. The balancer is provided on the outer circumferential surface of the rotor by inserting the balancer inside a pinhole formed in the outer circumferential surface of the rotor through an adhesive, or by fixing the balancer by a screw-in method inside a screw hole formed in the outer circumferential surface of the rotor. Therefore, when corrosion of the rotor advances due to a corrosive gas and the balancer falls off, rotor unbalance develops, so that an error is detected and the pump is stopped to prevent an accident. In addition, by exchanging only this balancer portion, other portions (such as the rotor and the rotor blades) can be reutilized.

The present invention of this specification is characterized in that the balancer is formed integrally with the rotor, and that masking is performed on the fragile portion between the rotor and the balancer main body during anti-corrosion plating of the rotor.

In accordance with the present invention, the balancer is formed integrally with the rotor and possesses a corrosion detecting function and a balancing function. The fragile portion has a small diameter and masking is performed on this portion during anti-corrosive plating of the rotor, making the fragile portion a non-plated portion. This portion can therefore easily be imparted with a function as a fragile portion that is weak with respect to corrosive gasses.

BRIEF DESCRIPTION OF THE DRAWINGS

FIG. 4 is a view showing the structure of a second embodiment of a balancer in a vacuum pump according to the present invention.

FIGS. 5A and 5B are sectional views showing the structure of a third embodiment of a balancer in a vacuum pump relating to the present invention. FIG. 5A is a view showing the case of masked to the balancer all over. FIG. 5B is a view showing the case of masked to an only fragile portion of the balancer.

DESCRIPTION OF THE PREFERRED EMBODIMENT

Embodiments of using a vacuum pump according to the present invention during semiconductor manufacture are explained in detail below with reference to the drawings.

Figure 1:
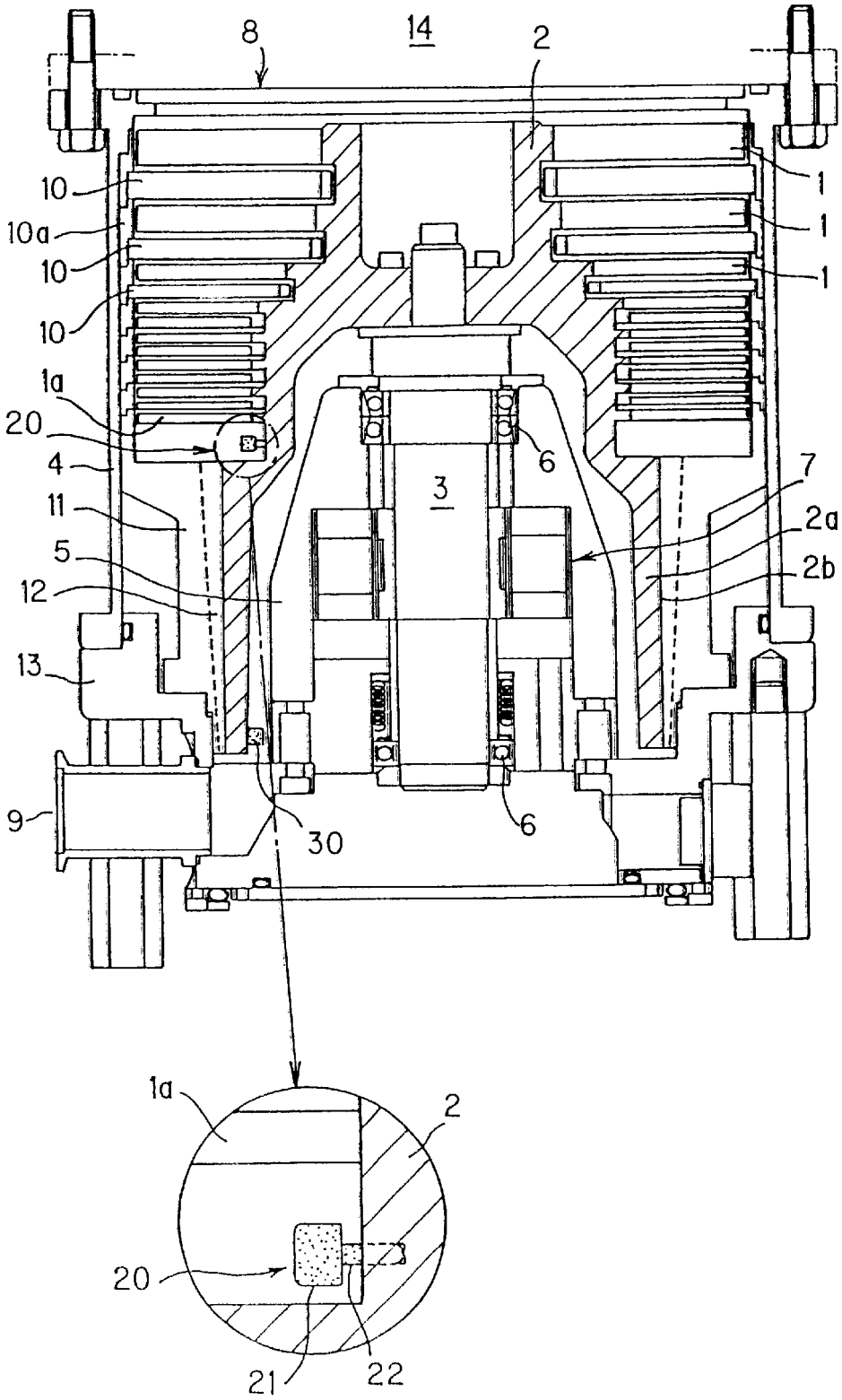
FIG. 1 is a vertical sectional view showing an embodiment of a vacuum pump according to the present invention.
Figures 2, 3:
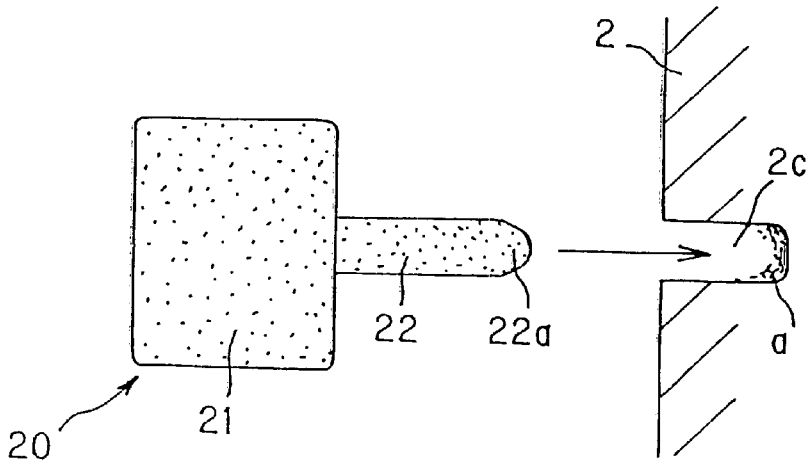
FIG. 2 is an explanatory flow diagram showing operations of a balancer in a vacuum pump relating to the present invention.
FIG. 3 is a view showing the structure of a first embodiment of a balancer in a vacuum pump according to the present invention.
Figure 6:
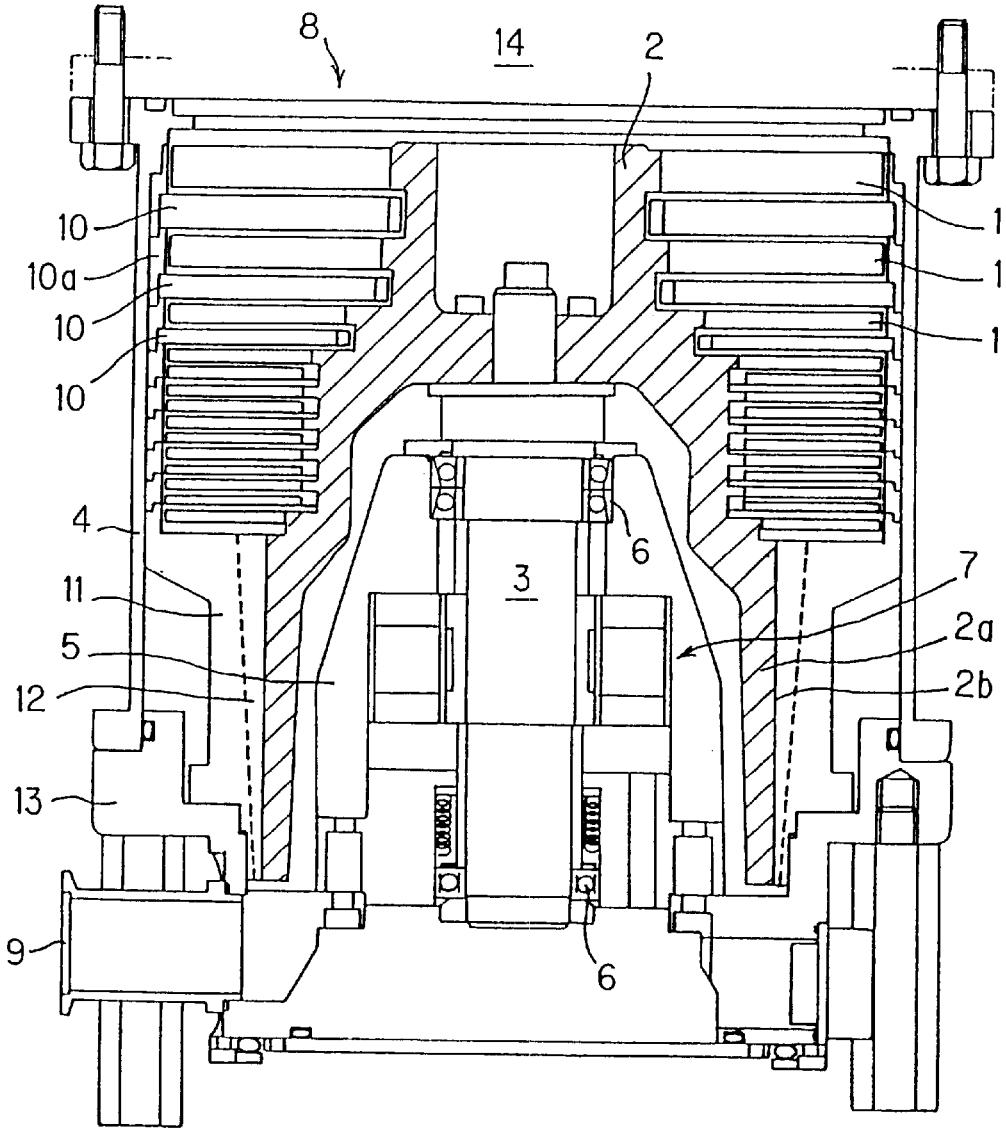
FIG. 6 PRIOR ART
FIG. 6 is a vertical sectional view showing the overall structure of a conventional vacuum pump.

FIG. 1 is a vertical cross sectional view showing an embodiment of a vacuum pump according to the present invention; FIG. 2 illustrates a flow of operations of a vacuum pump according to the present invention; FIG. 3 is an explanatory view indicating a first embodiment of a balancer in a vacuum pump according to the present invention; FIG. 4 is an explanatory view indicating a second embodiment of a balancer in a vacuum pump according to the present invention; and FIGS. 5A and 5B are cross sectional views indicating a third embodiment of a balancer in a vacuum pump according to the present invention. Note that the vacuum pump shown in FIG. 1 is similar to the conventional vacuum pump shown in FIG. 6 in that a vacuum pump action is generated by an upper portion turbo molecular pump mechanism and a lower portion thread groove pump mechanism. Identical reference symbols are therefore given to denote portions in the figures that are identical to those of FIG. 6, and an explanation of those portions is omitted.

A balancer 20 is attached to an outer circumferential surface of the rotor 2 below a lowest stage rotor blade 1*a* of the rotor blades 1 formed integrally with the rotor 2 in the vacuum pump shown in FIG. 1.

The balancer 20 is characterized by being provided with a function for balancing the rotor 2 and a corrosion detection function. The balancer 20 is therefore provided in a protruding shape so as to face the inside of a gas passageway from the outer circumferential surface of the rotor 2. A large diameter balancer body 21 in the outer circumferential surface of the rotor 2 is supported by a small diameter fragile portion 22.

A material of the balancer 20 which is weaker than the outer circumferential surface of the rotor 2 with respect to corrosive gasses, such as an aluminum alloy, and the fragile portion 22 is set to have a small diameter and an anti-corrosive plating process is not performed thereon, so that the balancer 20 will easily fall off when corrosion has progressed inside thereof.

Accordingly, when the vacuum pump according to the present invention is used for semiconductor manufacturing, the turbo molecular pump mechanism functions by interaction between stator blades 10 and the rotor blades 1, provided that the rotor shaft 3 supported by the stator column 5 is rotated at high speed by the driving motor 7. A corrosive gas within the vacuum chamber 14 is sucked into the pump through the inlet port 8, and in addition, the corrosive gas is exhausted from the exhaust port 9 via a thread groove 12 constituting the thread groove pump mechanism.

Anti-corrosion plating process such as chromium plating is performed on the rotor blades 1, the rotor 2, the stator blades 10, the thread groove 12, and the like facing towards the inside of the passageway of the corrosive gas. The balancer 20, however, does not have an anti-corrosive structure with respect to the corrosive gas, and the aluminum alloy or the like that is weak with respect to corrosion is left exposed.

Further, the rotor shaft 3, formed integrally with the rotor 2, is supported by the stator column 5 through the ball bearing 6, and a vibration sensor 30 for detecting errors is placed at a suitable position on an inner wall of the rotor 2. Note that there are no particular limitations placed on the placement location for the vibration sensor 30, but an unbalanced state can be detected with good precision by placing it in a portion below the rotor 2.

The vacuum pump according to the present invention is structured as stated above, and therefore operations denoted by reference symbols 1 to 4 shown in FIG. 2 are performed against corrosion. That is, the inside of the gas passageway is often exposed to the corrosive gas when the vacuum pump is used for a long period of time for a dry etching process or a CVD process in semiconductor manufacture. Accordingly, the balancer 20 drops off from the rotor 2 with the fragile portion 22 as a base point before the influence of corrosion due to the corrosive gas appears in the rotor blades 1 or the rotor 2, due to the fact that the balancer 20 that functions as a corrosion detector is formed by a material which is particularly weak with respect to corrosion.

The balancer 20 has a balancing function, and therefore an unbalanced state develops instantaneously in the rotor 2 when the balancer 20 falls off from the rotor 2.

If an unbalanced state develops with the rotor 2, then a signal is input to a controller apparatus (not shown in the figures) from the vibration sensor 30 formed on the inner wall of the lower portion of the rotor 2, the driving motor 7 stops driving due to a command from the controller apparatus, and the vacuum pump driver stops.

The vacuum pump can thus be forcibly stopped in accordance with the balancer 20 falling off before adverse effects such as rotor damage appear in the rotor 2 or the rotor blades 1, and therefore rotor breakage can be prevented from happening. Further, there are also advantages in that there is also no breakage in the pump casing 4 side and the vacuum chamber 14 side, so that the reliability and safety of the vacuum pump and peripheral apparatuses can be increased.

Embodiments of the balancer 20 are explained next based on FIGS. 3 to 5.

FIG. 3 shows an embodiment for fixing the balancer 20 to the outer circumferential surface of the rotor 2 by an adhesion method, and in particular, therefore, adhesive fixing and press fitting are used in combination. That is, a press fitting pin portion 22*a* is formed at a tip of the fragile portion 22 in the balancer 20, and along with being press fit into the inside of a pinhole 2*c* that is drilled into the press fitting portion 22*a* and the rotor 2, an adhesive a is applied to a bottom portion of the pinhole 2*c*. The balancer 20 is fixed to the outer circumferential surface of the rotor 2 by the press fitting and the adhesion fixing with the adhesive a.

A good attachment strength such that the balancer 20 does not fall out due to centrifugal force even if the rotor is rotating at high speed, can thus be obtained. At the same time, a corrosion detecting function can be obtained by providing the fragile portion 22 that is weak with respect to corrosion.

Further, the balancer 20 may also be directly fixed to the outer circumferential surface of the rotor 2 by adhesive fixing through the adhesive a without drilling the pinhole 2*c* in the rotor 2. In this case, it is necessary to ensure that there is a large adhesion surface area, and therefore it is preferable to form an attachment flange on the side of the fragile portion 22 adhering to the outer circumferential surface of the rotor 2.

The balancer 20 having the adhesive fixing structure shown in FIG. 3 is not only provided with the aforementioned corrosion detecting function, but also the function for balancing the rotor 2. In addition to that balancing can be performed simply by cutting off the balancer main body 21 in the balancer 20, because the corrosion detecting function of the balancer 20 works in a state in which there is almost no damage to the rotor 2 and the rotor blades 1, there is an attendant advantage in that the rotor 2 and the rotor blades 1 can be utilized again.

Next, FIG. 4 shows a second embodiment employing a screw-in method as a means of fixing the balancer 20. A male screw portion 22*b* is cut into a tip of the fragile portion 22 supporting the balancer main body 21, and a screw hole 2*d* constituting a female screw portion is formed on the outer circumferential surface of the rotor 2 so as to screw together with the male screw portion 22*b*.

In accordance with the second embodiment of the balancer 20, an attachment strength able to withstand the centrifugal force resulting from high speed rotation of the motor 2 can be ensured when the balancer 20 is fixed to the outer circumferential surface of the rotor 2 by a screw-in method. In addition, the fragile portion 22 is exposed within the gas passageway when the balancer 20 is fixed to the outer circumferential surface of the rotor 2 by being screwed in, and therefore the corrosion detecting function is not lost at all.

Balancing of the rotor 2 can easily be performed also in the screw-in method, and the rotor 2 and the rotor blades 1 can be utilized again.

Next, FIGS. 5A and 5B shows a third embodiment in which the balancer 20 and the rotor 2 form an integral structure, and the balancer 20 is attached to the outer circumferential surface of the rotor by cutting. In other words, a cutting process may be performed so as to form the balancer main body 21 and the small diameter fragile portion 22 integrally with the rotor 2 during the cutting process for forming the rotor 2. In addition, provided that masking of an outer surface of the balancer 20 is performed, and an anti-corrosion plating process such as chromium plating is performed to the outer surface of the rotor 2 (an anti-corrosion plating layer is shown by reference symbol P in FIG. 5), the fragile portion 22 that is weak with respect to the corrosive gas can be easily formed.

Note that the entire balancer 20 may be masked, as shown in FIG. 5A. However, if this masking process seems tedious, at least the fragile portion 22 may be masked, as shown in FIG. 5B. Non-plated portions are denoted by reference symbols d1 and d2 within the figures.

The balancer 20 provided with the corrosion detecting function and the balancing function may thus employ a structure in which the rotor 2 and the separate balancer 20 are fixed together, and may employ an integral structure in which the balancer 20 is formed integrally with the rotor 2 during the cutting process of the rotor 2.

Further, in this embodiment mode, the rotor shaft 3 formed integrally along the rotation axis of the rotor 2 by fastening with a bolt, is supported by the ball bearing 6 against the stator column 5, and the vibration sensor 30 is used as a sensor for detecting an unbalanced state of the rotor 2. However, when using a magnetic support type bearing for supporting the rotor 3 by the stator column 5 by means of magnetic bearing, a radial direction sensor may be placed between the rotor shaft 3 and the stator column 5, and an unbalanced state of the rotor 2 may be detected by this radial direction sensor.

In addition, although the vacuum pump according to the present invention is of a type that uses the turbo molecular pump mechanism portion in the upper half portion of the rotor 2 together with the thread groove pump mechanism portion in the lower half portion of the rotor 2, the present invention may also be applied to a vacuum pump using only a turbo molecular pump mechanism.

As explained above, the vacuum pump relating to the present invention is constructed such that the balancer having two functions, namely the corrosion detecting function and the balancing function, is provided on the outer circumferential surface of the rotor. The balancer is supported in the outer circumferential surface of the rotor by the fragile portion that is weak with respect to corrosive gasses, and therefore the balancer falls off before the corrosion occurring due to the corrosive gasses within the gas passageway inside of the pump affects the rotor blades or the rotor. An unbalanced state thus forcibly appears in the rotor, and rotor breakage due to corrosion is prevented from occurring. Breakage of the stator blades, the screw stator, and the like can therefore be prevented. In addition, damage to peripheral apparatuses such as a vacuum chamber and outflows of processing gasses to the outside do not occur, so that there is obtained an effect that the reliability and the safety of the pump and peripheral apparatuses are increased.

In addition, in accordance with the vacuum pump according to the present invention, the balancer in the outer circumferential surface of the rotor is provided with the corrosion detecting function and the balancing function, and balancing of the entire rotor can be accomplished simply by cutting off a part of the balancer. Additionally, balancing can be easily performed without a reduction in rigidity, such as with balancing performed by opening holes in the rotor, and rotor rigidity can be well maintained.

What is claimed is:

1. A vacuum pump comprising:

a pump casing having an intake port and a plurality of stages of stator blades disposed on an inner circumferential surface thereof;

a stator column accommodated and fixed inside the pump casing, for supporting a rotor shaft that rotates;

a rotor integrated with the rotor shaft and having a plurality of stages of rotor blades disposed on an outer circumferential surface thereof such that the rotor blades are disposed alternately with the stator blades of the pump casing; and a balancer provided in the outer circumferential surface of the rotor, and having a balancing function and a corrosion detecting function.

2. A vacuum pump according to claim 1, wherein the balancer is attached to the outer circumferential surface of the rotor through a fragile portion that is weak with respect to corrosive gasses.

3. A vacuum pump according to claim 1, wherein the balancer is made up of a material which weaker than the outer circumferential surface of the rotor with respect to corrosive gasses.

4. A vacuum pump according to claim 1, wherein the balancer has a fragile portion that is weak with respect to corrosive gasses.

5. A vacuum pump according to claim 4, wherein the fragile portion is set in a smaller diameter than a balancer main body.

6. A vacuum pump according to claim 5, wherein the fragile portion is pressure-fixed through an adhesive within a pinhole formed in the outer circumferential surface of the rotor.

7. A vacuum pump according to claim 5, wherein the balancer is screwed into the inside of a screw hole drilled in the outer circumferential surface of the rotor.

8. A vacuum pump comprising:

a pump casing having an intake port and a plurality of stages of stator blades disposed on an inner circumferential surface thereof;

a stator column accommodated and fixed inside the pump casing, for supporting a rotor shaft that rotates;

a rotor integrated with the rotor shaft and having a plurality of stages of rotor blades disposed on an outer circumferential surface thereof such that the rotor blades are disposed alternately with the stator blades of the pump casing; and a balancer is formed integrally with the rotor, and having a balancing function and a corrosion detecting function.

* * * * *